United States Patent [19]

Grise

[11] Patent Number: 4,542,285

[45] Date of Patent: Sep. 17, 1985

[54] ELECTRICAL HEATER

[75] Inventor: Frederick G. J. Grise, Osterville, Mass.

[73] Assignee: Flexwatt Corporation, Canton, Mass.

[21] Appl. No.: 646,688

[22] Filed: Aug. 31, 1984

Related U.S. Application Data

[63] Continuation-in-part of Ser. No. 580,472, Feb. 15, 1984.

[51] Int. Cl.[4] ..... H05B 3/16

[52] U.S. Cl. ..... 219/543; 219/528; 219/541; 219/544; 219/549; 338/212; 338/309; 338/328

[58] Field of Search ..... 219/203, 211, 212, 345, 219/527, 528, 541, 543, 544, 549, 552; 338/212, 309, 314, 323, 328

[56] References Cited

U.S. PATENT DOCUMENTS

| | | | |
|---|---|---|---|
| 2,473,183 | 6/1949 | Watson | 219/543 |
| 3,749,886 | 7/1973 | Michaelson | 219/528 |
| 4,023,008 | 5/1977 | Durussel | 219/522 |
| 4,388,522 | 6/1983 | Boaz | 219/543 X |
| 4,450,346 | 5/1984 | Boaz | 219/522 |
| 4,453,669 | 6/1984 | Karla et al. | 219/543 X |
| 4,485,297 | 11/1984 | Grise et al. | 219/528 |

*Primary Examiner*—Volodymyr Y. Mayewsky

[57] ABSTRACT

A sheet heater including a substrate, a semi-conductor pattern (typically of colloidal graphite) having a pair of parallel, spaced-apart, longitudinally-extending stripes and a central portion extending between and electrically connected to the stripes, and a pair of parallel, spaced-apart, longitudinally-extending conductors one of which overlies and engages each of the stripes. Each conductor is significantly wider than the underlying stripe of the semi-conductor pattern, and includes a longitudinally extending strip portions along the inner and outer edges of the conductor, and a plurality of longitudinally-spaced openings located therebetween. The strip portion at the inner edge of the conductor overlies and engages a respective stripe; and a sealing layer of insulating material overlies the respective conductor and is sealed to the substrate along the inner and outer edges of the conductor and through the longitudinally spaced openings.

8 Claims, 3 Drawing Figures

ELECTRICAL HEATER

This invention relates to electrical heating devices. This application is a continuation-in-part of U.S. application Ser. No. 580,472, filed Feb. 15, 1984.

BACKGROUND OF INVENTION

U.S. patent applications Ser. No. 181,974, filed Aug. 28, 1980 and now abandoned, Ser. No. 295,400, filed Aug. 21, 1981, now U.S. Pat. No. 4,485,297, issued Nov. 27, 1984, Ser. No. 478,080 filed Mar. 23, 1983, and Ser. No. 572,678, filed Jan. 20, 1984, all of which, together with Ser. No. 580,742, are owned by the assignee of the present application and are here incorporated by reference, disclose flexible sheet heaters including a pair of longitudinally-extending (typically copper) conductors, and a semi-conductor pattern extending between and electrically connected to the conductors. The heaters there disclosed provide generaly superior performance and substantially even heat distribution, and are useful in a wide range of applications.

There are circumstances, however, in which the heater may be subjected to unusual or extreme conditions. For example, Ser. No. 580,472 discloses that heaters may be used as, for example, firing range targets. When used as a target for small arms, there is a very real chance that a bullet may strike and sever one of the longitudinally-extending conductors, and render the heater inoperative. Similarly, the shock of a large calibre shell, when for example the target is used on an anti-tank weapons range, may cause partial delamination or other structural damage, even when the "hit" is wholly in the area between conductors. High stresses or risk of breakage may be presented in other environments or applications; and other potential difficulties are presented by the need, in some applications, to operate using relatively high voltage or current levels.

SUMMARY OF INVENTION

The present invention provides an electrical sheet heater which has greater structural strength and integrity and in which the risk of failure from breaking or cutting of a conductor is significantly decreased. The invention also provides for a higher current carrying capability, and, particularly in those embodiments the semi-conductor pattern between conductors is an essentially solid layer, for more even heat distribution adjacent the inner edges of the conductors.

In general, I have discovered that a sheet heater including a substrate, a semi-conductor pattern (typically of colloidal graphite) having a pair of parallel, spaced-apart, longitudinally-extending stripes and a central portion extending between and electrically connected to the stripes, and a pair of parallel, spaced-apart, longitudinally-extending conductors one of which overlies and engages each of the stripes, will provide all the above advantages if each conductor is significantly wider than the respective underlying stripe of the semi-conductor pattern, and includes transversely-spaced, longitudinally-extending strip portions along and spaced from the inner edge of the conductor, and a plurality of longitudinally-spaced openings located therebetween. The strip portion at the inner edge of the conductor overlies and engages a respective stripe; and a sealing layer of insulating material overlies the respective conductor and is sealed to the substrate along the inner and outer edges of the conductor and through the longitudinally spaced openings.

In preferred embodiments, the conductor includes two rows of longitudinally-extending openings, each opening is generally rectangular not less than about $\frac{1}{4}$ inch on a side, and there is a solid strip portion about $\frac{1}{8}$ inch wide is provided between the two rows of openings and along the inner and outer edges of the conductor.

DRAWINGS

FIG. 1 is a plan view of an electrical heating device embodying the present invention, with the sealing layer removed.

FIG. 2 a plan view, partially in section and with the top sealing layer removed, of portions of the heater of FIG. 1.

FIG. 3 is a sectional view, taken at 3—3 of FIG. 2, with the sealing layer in place.

DETAILED DESCRIPTION

Figure 1:
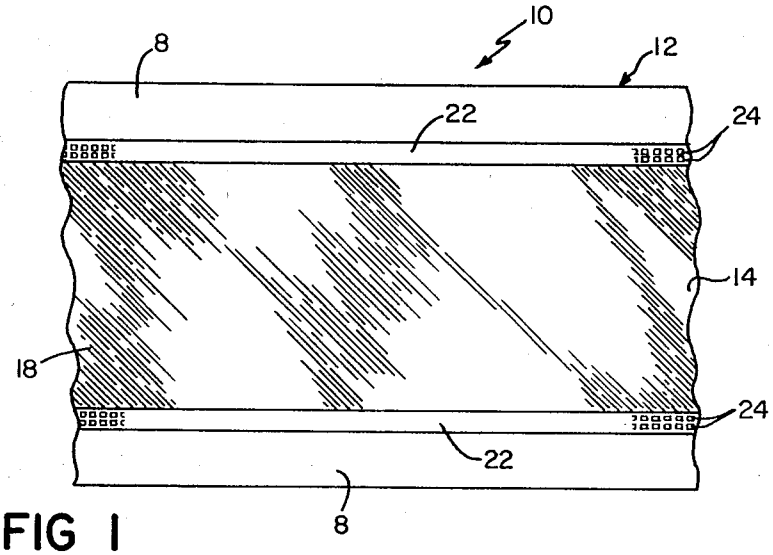

Referring to the drawings, there is shown an electrical sheet heater, generally designated 10, comprising a plastic substrate 12 on which is printed a semi-conductor pattern 14 of colloidal graphite. Uncoated side boundary areas 8, each comprising a strip about $1\frac{1}{2}$ inches wide, extend from the outer side edges of pattern 14 to the side (longitudinal) edges of substrate 12. Substrate 12 is 0.004 inch thick polyester ("Mylar"), and as will be evident from the drawings is essentially transparent. The semi-conductor pattern 14 is printed on the substrate at the thickness required to provide a watt density of about 15 watts per square foot (i.e., at a resistance of about 200 ohms per square); and includes a pair of parallel longitudinal stripes 16, each 5/32 inch wide and spaced 24 inches apart, and a central portion 18 printed over substantially the entire area between stripes 16. The only areas between stripes 16 not so covered are a series of small rectangles 40, each about $\frac{1}{8}$ inch in height (measured parallel to stripes 16) and 3/16 inch in width (measured transverse to stripes 16) spaced along the inside of each edge of each stripe 16. The distance between adjacent rectangles 40 is $\frac{1}{4}$ inch.

Figure 2:
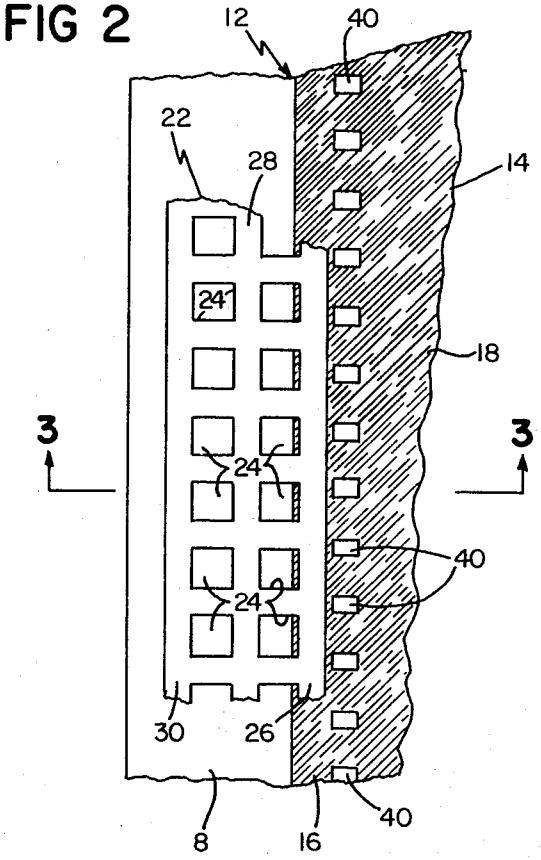

A pair of electrodes 22, each comprising a tinned copper strip 1 inch wide and 0.003 inch thick, extend longitudinally of the heater, one electrode extending along and engaging each of stripes 14. As shown most clearly in FIG. 2 each electrode includes two transversely-spaced, longitudinally-extending rows of spaced square holes 24. Solid copper strips, designated 26, 28 and 30 respectively, are provided along the inner and outer edges of the electrode, and between the two rows of holes 24. In the illustrated embodiment, each hole 24 is 5/16 inch. square, each of strips 26, 28 and 30 is $\frac{1}{8}$ inch wide, and the space beteen adjacent holes in each row is also $\frac{1}{8}$ inch. As will be apparent, the $\frac{1}{8}$ inch width of strip 26 is slightly less than the 5/16 inch width of the semi-conductor stripe 16 which the strip overlies.

Figure 3:
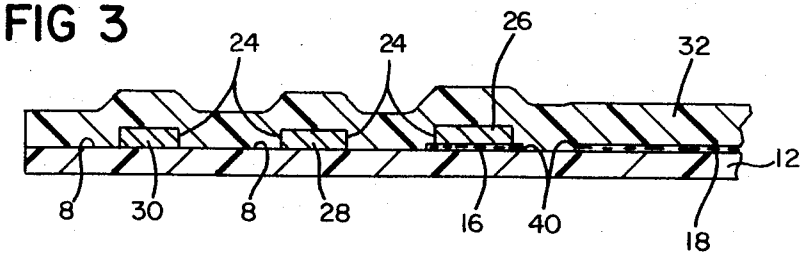

A thin plastic cover sheet 32 [shown in FIG. 3 and comprising an essentially transparent co-lamination of an 0.005 cm. (0.002 in.) thick polyester ("Mylar") and an 0.007 cm (0.003 in.) thick adhesive binder, e.g., polyethylene] overlies substrate 12, semi-conductor pattern 14 and conductors 22. The conductors 22 are not themselves bonded to the underlying substrate or semi-conductor material, and the cover sheet bonds poorly to the semi-conductor pattern. However, the polyethylene forming the bottom layer of cover sheet 32 bonds well to substrate 12. In particular, the cover sheet and substrate are laminated together (as taught in Ser. No. 572,578) and the polyethylene bottom layer of cover sheet 32 bonds the cover sheet tightly the longitudinally-extending, uncoated (with semi-conductor material) areas 8 of substrate 12 between the outside edge of each conductor 22 and the adjacent outside edge of the heater and through the two rows of holes 24 in each conductor 22. Sheet 32 also is bonded to the uncoated (with semi-conductor material) rectangular areas 40 spaced along the inside edge of each conductor 22. Sheet 32 thus holds the conductors 22 tightly in place against the underlying semi-conductor stripes 16. Further, because the substrate 12 and cover sheet 32 are sealed tightly to each other in the areas 8 between the outside edge of conductors 22 and the outer edges of the heater, the unit is essentially heremetically sealed.

It will be noted that, typically, semi-conductor material underlies only one of the longitudinally-extending strip portions of each conductor 22, i.e., interior strip portion 26.

The conductors 22 of the completed heater may be connected to a source of power by any of a variety of connectors, including those discussed in aforementioned Ser. Nos. 295,400 and 572,678.

OTHER EMBODIMENTS

Various modifications may be made in other embodiments.

For example, in lieu of a sealing layer overlying substantially the entire substrate 12, a narrow (about $1\frac{1}{2}$ inch wide) strip of polyester tape with an acrylic heating (typically a transparent "Mylar" tape obtained from either 3M Corp. of St. Paul, Minn. or Ideal Tape, Inc. of Lowell, Mass.) may overlie each conductor (but not the major portion of the semi-conductor pattern between conductors) and hold it in tight face-to-face engagement with the underlying substrate and semi-conductor stripe. Each such tape strip should be at least $\frac{1}{4}$ to $\frac{1}{2}$ inch wider than the conductor, and will be sealed to the substrate along the inside and outside edges of the respective conductor and through the openings in the conductor. In such circumstances the central semi-conductor pattern area not covered with a tape strip typically will be coated with a dielectric, theremally-conductive polyester material, such as can be obtained from Amicon Corp. of Lexington, Mass.

Similarly, the conductor itself may include only a single row of longitudinally-spaced central openings. If, for example, a total conductor width of only about $\frac{1}{2}$ inch is required to provide the necessary current-carrying capacity, the outer row of openings 24 and the outer edge strip portion 30 may be omitted.

Other embodiments will be within the scope of the following claims.

What is claimed is:

1. In a sheet heater including a substrate, a semi-conductor pattern having a pair of parallel, spaced-apart, longitudinally-extending stripes and a central portion extending between and electrically connected to the stripes, and a pair of parallel, spaced-apart, longitudinally-extending conductors one of which overlies and engages each of the stripes, that improvement wherein:

each said conductor has a width greater than that of the respective underlying stripe of said semi-conductor pattern, and includes a pair of transversely-spaced, longitudinally-extending strip portions and a central portion including a plurality of longitudinally-spaced openings located therebetween, the said strip portion nearer the inner edge of the conductor overlying and engaging a respective one of said stripes; and, a sealing layer of insulating material overlies the respective conductor, said sealing layer being sealed to said substrate adjacent the transversely inner and outer edges of the conductor and through said longitudinally-spaced openings.

2. The sheet heater of claim 1 wherein said strip portions are positioned adjacent the opposite longitudinally-extending edges of said conductors.

3. The sheet heater of claim 1 wherein each of said conductors includes a central strip portion extending longitudinally thereof intermediate and spaced from each of said other strip portions thereof, and including a said central portion intermediate each adjacent pair of said strip portions thereof.

4. The sheet heater of claim 1 wherein said openings are generally rectangular.

5. The sheet heater of claim 1 wherein each of said strip portions is about $\frac{1}{8}$ inch wide and said openings are rectangular and have a width, measured transversely of said heater, of greater than $\frac{1}{8}$ inch.

6. The sheet heater of claim 5 wherein each of said openings is a square not less than about $\frac{1}{4}$ inch on a side.

7. The sheet heater of claim 1 wherein one of said strip portions is positioned adjacent a longitudinally-extending edge of each of said conductors, and has a width not more than about one-fourth the overall width of said each conductor.

8. The sheet heater of claim 1 wherein each of said openings has a width not less than about $\frac{1}{4}$ inch.

* * * * *